US007474056B2

(12) United States Patent
Kim et al.

(10) Patent No.: US 7,474,056 B2
(45) Date of Patent: Jan. 6, 2009

(54) LAMP, METHOD OF FABRICATING THE SAME AND LIQUID CRYSTAL DISPLAY APPARATUS HAVING THE SAME

(75) Inventors: Byung-Hyun Kim, Suwon-si (KR); Sung-Chul Kang, Yongin-si (KR); Weon-Sik Oh, Osan-si (KR); Keun-Woo Lee, Hwaseong-gun (KR); Hyeong-Suk Yoo, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 636 days.

(21) Appl. No.: 10/508,587

(22) PCT Filed: Mar. 19, 2003

(86) PCT No.: PCT/KR03/00535

§ 371 (c)(1),
(2), (4) Date: May 13, 2005

(87) PCT Pub. No.: WO03/081636

PCT Pub. Date: Oct. 2, 2003

(65) Prior Publication Data

US 2005/0218783 A1 Oct. 6, 2005

(30) Foreign Application Priority Data

Mar. 22, 2002 (KR) ..... 10-2002-0015602

(51) Int. Cl.
*H01J 65/00* (2006.01)

(52) U.S. Cl. ..... 313/607; 313/574; 313/594; 313/234; 313/491; 313/113; 445/26; 349/70; 349/113

(58) Field of Classification Search ..... 313/491, 313/574, 594, 607, 623, 624, 631, 234, 356
See application file for complete search history.

(56) References Cited

U.S. PATENT DOCUMENTS 6,515,433 B1 * 2/2003 Ge et al. ..... 315/227 R
7,211,939 B2 * 5/2007 Lim ..... 313/234

FOREIGN PATENT DOCUMENTS

EP 0 836 220 A1 4/1998

(Continued)

OTHER PUBLICATIONS

PCT International Search Report; International Application No. PCT/KR03/00535; International Filing Date: Jul. 3, 2003.

(Continued)

*Primary Examiner*—Ashok Patel
(74) *Attorney, Agent, or Firm*—Cantor Colburn LLP

(57) ABSTRACT

Disclosed are a lamp, a method of fabricating the same and an LCD having the same. Electrode is disposed on an outer surface of a lamp tube, and an adhesive member is interposed between the electrode and the lamp tube. The adhesive member is hardened and expanded by means of heating, and adheres the electrode to the lamp tube. Thus, voids generated during forming the electrode on the outer surface is removed, and images having a high quality are obtained.

19 Claims, 10 Drawing Sheets

FOREIGN PATENT DOCUMENTS

| | | |
|---|---|---|
| JP | 61-91853 | 5/1986 |
| JP | 01-140552 | 6/1989 |
| JP | 1-140552 | 6/1989 |
| JP | 8-329903 | 12/1996 |
| JP | 2000-066200 | 3/2000 |
| WO | 01/79922 | 10/2001 |

OTHER PUBLICATIONS

PCT International Preliminary Examination Report; International Application No. PCT/KR2003/000535; Aug. 25, 2004.

Chinese Office Action to Chinese Patent Application No. 03806619.X; Date of Mailing Sep. 18, 2006.

* cited by examiner

LAMP, METHOD OF FABRICATING THE SAME AND LIQUID CRYSTAL DISPLAY APPARATUS HAVING THE SAME

TECHNICAL FIELD

The present invention relates to a lamp and an LCD (Liquid Crystal Display), and more particularly to a lamp, a method of fabricating the same and an LCD having the same, which reduces a power consumption and prevents a light efficiency from being decreased.

BACKGROUND ART

In general, an LCD apparatus displays image using electro-optics properties of a liquid crystal. To display a high-quality image with the LCD apparatus, technologies of utilizing material properties of the liquid crystal, controlling the liquid crystal and improving optical properties of a light are required.

Even though the liquid crystal can be precisely controlled, the quality of the image depends on the optical properties of the light passing through the liquid crystal because the liquid crystal does not generate a light but only controls the transmissivity of the light incident from an external.

Thus, technologies for improving the optical properties of the light are rapidly developed with the technologies for controlling the liquid crystal.

The technologies for improving the optical properties of the light which transmits through the liquid crystal are classified into a technology for improving properties of a light source and a technology for improving the properties of the light from the light source.

In general, it is required that a surface light source such as sunlight is used as the light source of the LCD apparatus. However, since it is difficult to apply the surface light source to the LCD apparatus, a CCFL (Cold Cathode Fluorescent Lamp) having a line light source is widely used as the light source of the LCD apparatus.

The CCFL includes a lamp tube having a fluorescent material formed on an inner surface thereof and a discharge gas injected into the lamp tube and a pair of electrodes. The electrodes are facing to each other and are disposed in the lamp tube.

When applying discharge voltage to the electrodes, electrons are emitted from a first electrode of the electrodes toward a second electrode facing the first electrode. The electrons collide with the discharge gas to dissociate the discharge gas, so that a plasma state is formed in the lamp tube.

An invisible ray generated by colliding the electrons with the discharge gas is changed into a visible ray while passing through the fluorescent material.

When a plurality of CCFLs are connected to a power supply unit in parallel and the plurality of CCFLs are simultaneously turned on, those CCFLs are turned on to have a non-uniform brightness. In addition, the CCFL has a high power consumption.

DISCLOSURE OF THE INVENTION

The present invention provides a lamp for reducing power consumption and preventing a light efficiency from being decreased.

The present invention also provides a method of fabricating a lamp for reducing power consumption and preventing a light efficiency from being decreased.

The present invention also provides an LCD apparatus having a lamp for reducing power consumption and preventing a light efficiency from being decreased.

In one aspect of the invention, there is provided a lamp comprising: a lamp tube for receiving a power voltage to generate a light; an electrode having a pair of electrodes for supplying the power voltage to the lamp tube, the pair of electrodes being separated from each other, and at least one electrode of the pair of electrodes being disposed on a first outer surface of the lamp tube as an outer electrode; and an adhesive means having a silver component and being disposed between the outer electrode and the lamp tube.

In another aspect, there is provided a method of fabricating a lamp, comprising the steps of: fabricating a lamp tube for receiving a power voltage to generate a light and an electrode being disposed on a first outer surface of the lamp tube as an outer electrode; forming an adhesive means including a silver between the lamp tube and the outer electrode; and hardening the adhesive means such that the lamp tube is adhered to the electrode.

In further aspect, there is provided an an LCD apparatus comprising: a lamp including a lamp tube for receiving a power voltage to generate a first light, an electrode having a pair of electrodes for supplying the power voltage to the lamp tube, the pair of electrodes being separated from each other and at least one electrode of the pair of electrodes being disposed on a first outer surface of the lamp tube as an outer electrode, and an adhesive means having a silver and being disposed between the outer electrode and the lamp tube; a brightness enhancing means for increasing a brightness of the first light; and an LCD panel for receiving a second light supplied from the brightness enhancing means and displaying an image in response to the second light.

BRIEF DESCRIPTION OF THE DRAWINGS

The above and other advantages of the present invention will become more apparently by describing in detail an exemplary embodiment thereof with reference to the accompanying drawings, in which.

BEST MODE FOR CARRYING OUT THE INVENTION

Figure 1:
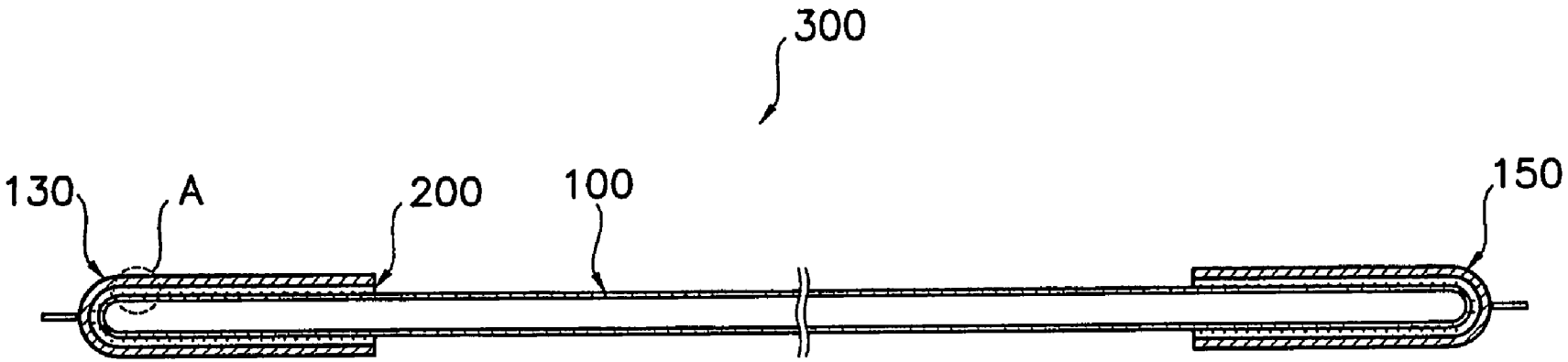
FIG. 1 is a cross-sectional view showing a lamp according to a first embodiment of the present invention.
Figure 2:
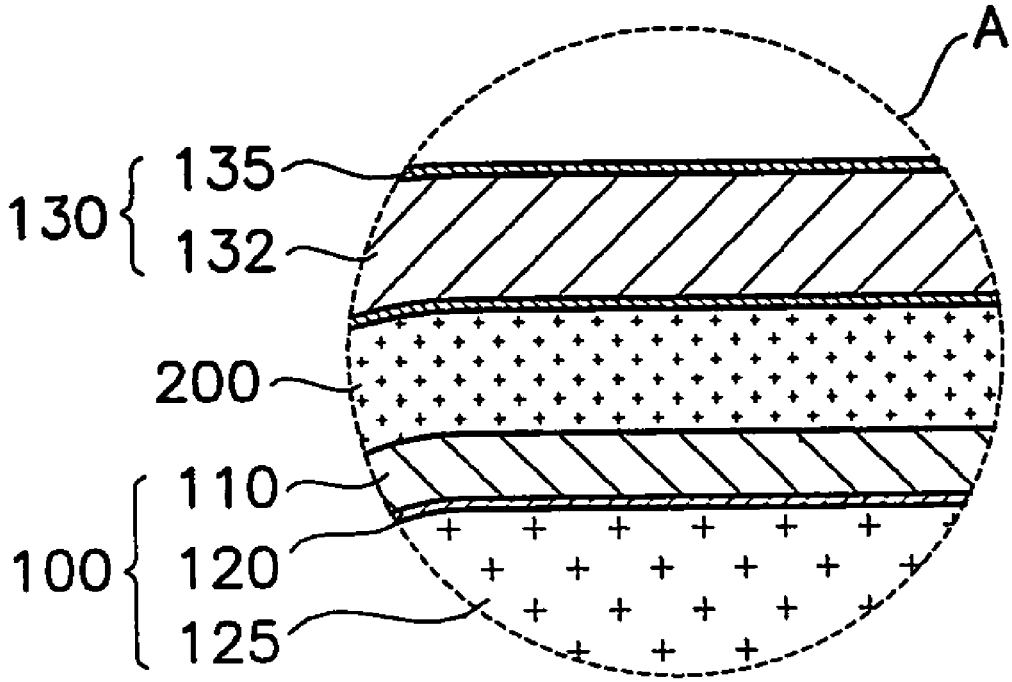
FIG. 2 is a partially enlarged view showing the lamp shown in FIG. 1.

FIG. 1 is a cross-sectional view showing a lamp according to a first embodiment of the present invention. FIG. 2 is a partially enlarged view showing the lamp shown in FIG. 1.

Referring to FIG. 1, a lamp includes a lamp tube 100 for emitting a light, a first and a second electrodes 130 and 150 for supplying a power voltage to the lamp tube 100, and an adhesive member 200. The adhesive member 200 is disposed between the lamp tube 100 and the first electrode 130, and between the lamp tube 100 and the second electrode 150. At least one of the first and the second electrodes 130 and 150 is disposed on an outer surface of the lamp tube 100. The adhesive member 200 includes a silver component.

Referring to FIG. 2, the lamp tube 100 includes a tube body 110, a fluorescent material layer 120 and a discharge gas 125. The tube body 110 having a predetermined dielectric constant is made of a glass and provides a discharge space. The fluorescent material layer 120 having a predetermined thickness is disposed on an inner surface of the tube body 120. The fluorescent material layer 120 changes an invisible ray into a visible ray. The discharge gas 125 injected into the tube body 120 is dissociated to ions by discharging inside the tube body 120 to generate the invisible ray. The discharging occurs by an electric field caused by an electric potential difference between the first and the second electrodes 130 and 150.

Both first and the second electrodes 130 and 150 are disposed on the outer surface of the tube body 110. The first and the second electrodes 130 and 150 have the same structure from each other. Hereinafter, the first electrode 130 will be described.

The first electrode 130 includes a base metal 132 and a conductive antioxidant layer 135 formed on the base metal 132. The base metal 132 is made of a conductive metal material such as a nickel (Ni) or a copper (Cu). The conductive antioxidant layer 135 prevents the base metal from being oxidized by an air and humidity. A metal material having a gilding surface is used as the conductive antioxidant layer 135. Thus, even if the conductive antioxidant layer 135 is exposed to the heat, the air and the humidity, the conductive antioxidant layer 135 is not easily oxidized.

Figure 3:
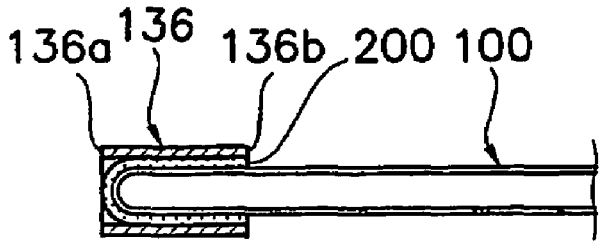
FIG. 3 is a cross-sectional view showing a lamp according to a second embodiment of the present invention.
Figure 4:
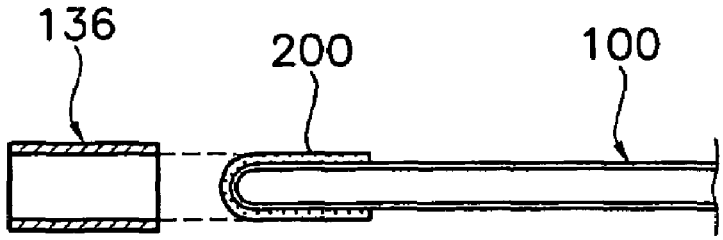
FIG. 4 is a cross-sectional view showing an assembling structure between a lamp tube and an electrode according to a first embodiment of the present invention.
Figure 5:
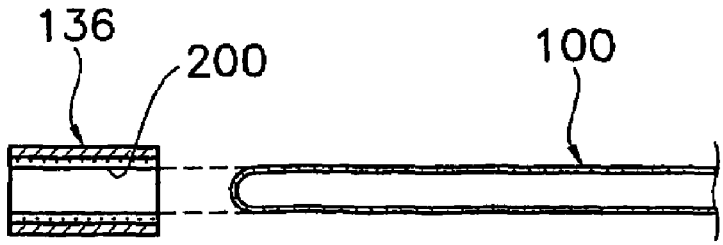
FIG. 5 is a cross-sectional view showing an assembling structure between a lamp tube and an electrode according to a second embodiment of the present invention.

FIG. 3 is a cross-sectional view showing a lamp according to a second embodiment of the present invention. FIG. 4 is a cross-sectional view showing an assembling structure between a lamp tube and an electrode according to a first embodiment of the present invention. FIG. 5 is a cross-sectional view showing an assembling structure between a lamp tube and an electrode according to a second embodiment of the present invention.

In FIG. 3, a first electrode according to the second embodiment of the present invention is indicated by a reference numeral "136".

Referring to FIG. 3, the first electrode 136 has a pipe shape that covers the outer surface of the tube body 110, and is separated from the outer surface of the tube body 110 in a predetermined distance. The first electrode 136 has a first end portion 136*a* and a second end portion 136*b* opposite to the first end portion 136*a*. The first and second end portions 136*a* and 136*b* are opened to engage with the tube body 110 of the lamp tube 100. The adhesive member 200 having the silver component is interposed between the outer surface of the tube body 110 and the first electrode 136.

The adhesive member 200 includes a silver grain, a resin having an adhesive strength for maintaining a shape of the silver grain and a volatility solvent for hardening the resin. The adhesive member 200 further includes an antioxidant for preventing the silver grain from being oxidized.

The adhesive member 200 has properties such as a good conductivity, a thermal expansion, a low resistance, an adhesive strength and an airtight condition and so on. Also, the resin in the adhesive member 200 has the adhesive strength and adheres the first electrode 136 to the tube body 110 to prevent the first electrode 136 from being deviated from the tube body 110.

Referring to FIG. 4, the adhesive member 200 is formed on the outer surface of the tube body 110 of the lamp tube 100, and then the lamp tube 100 is inserted into the first electrode 136 having the gilding surface. On the contrary, after forming the adhesive member 200 on an inner surface of the first electrode 136 as shown in FIG. 5, the lamp tube 100 is inserted into the first electrode 136 having the gilding surface.

The first electrode 136 and the lamp tube 100 having the adhesive member 200 interposed therebetween are heated at a temperature of about 300 to about 400° C., preferably about 350° C. The resin in the adhesive member 200 interposed between the first electrode 136 and the lamp tube 100 are hardened by means of heating, and the adhesive member 200 are expanded, thereby removing voids disposed between the first electrode 136 and the lamp tube 100. Thus, an contacted area between the first electrode 136 and the lamp tube 100 increases, and power consumption by the lamp tube 100 reduces.

Figure 6:
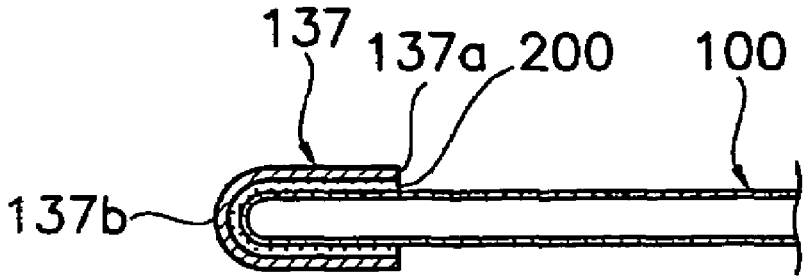
FIG. 6 is a cross-sectional view showing an assembling structure between a lamp tube and an electrode according to a third embodiment of the present invention.
Figure 7:
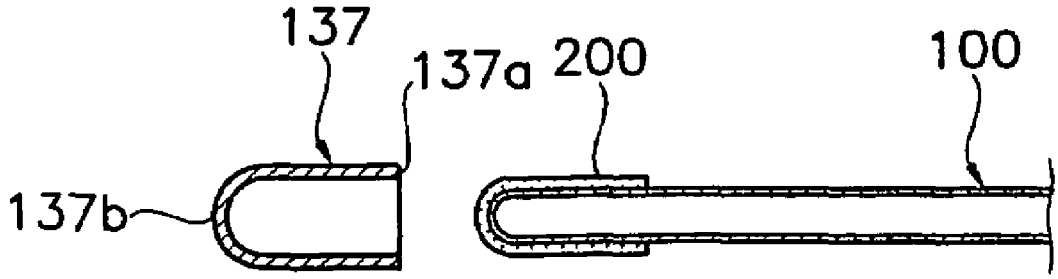
FIG. 7 is a cross-sectional view showing an assembling structure between a lamp tube and an electrode according to a fourth embodiment of the present invention.
Figure 8:
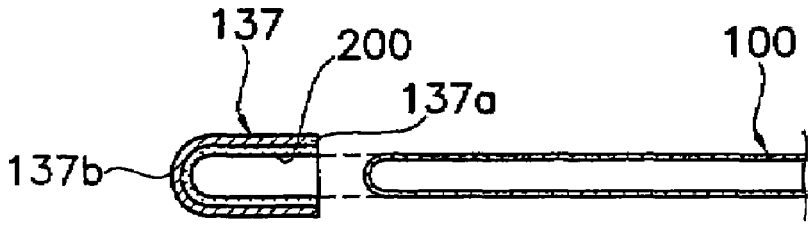
FIG. 8 is a cross-sectional view showing an assembling structure between a lamp tube and an electrode according to a fifth embodiment of the present invention.

FIG. 6 is a cross-sectional view showing an assembling structure between a lamp tube and an electrode according to a third embodiment of the present invention. FIG. 7 is a cross-sectional view showing an assembling structure between a lamp tube and an electrode according to a fourth embodiment of the present invention. FIG. 8 is a cross-sectional view showing an assembling structure between a lamp tube and an electrode according to a fifth embodiment of the present invention. In FIG. 6, a first electrode according to the third embodiment of the present invention is indicated by a reference numeral "137".

Referring to FIG. 6, the first electrode 137 has a bucket shape that covers the outer surface of the tube body 110 and is separated from the outer surface of the tube body 110 in a predetermined distance. The first electrode 137 has a first end portion 137*a* and a second end portion 137*b* opposite to the first end portion 137*a*. The first end portion 137*a* is opened to engage with the tube body 110 of the lamp tube 100, and the second end portion 137*b* is not opened as shown in FIG. 7. The adhesive member 200 having the silver component is interposed between the outer surface of the tube body 110 and the first electrode 137.

Referring to FIG. 7, the adhesive member 200 is formed on the outer surface of the tube body 110 of the lamp tube 100, and then the lamp tube 100 is inserted into the first electrode 137 having the gilding surface. On the contrary, after forming the adhesive member 200 on an inner surface of the first electrode 137 as shown in FIG. 8, the lamp tube 100 is inserted into the first electrode 137 having the gilding surface.

The first electrode 137 and the lamp tube 100 having the adhesive member 200 interposed therebetween are heated at a temperature of about 300 to about 400° C., preferably about 350° C. The resin in the adhesive member 200 interposed between the first electrode 137 and the lamp tube 100 are hardened and expanded by means of heating, thereby removing voids disposed between the first electrode 137 and the lamp tube 100. Thus, a contacted area between the first electrode 136 and the lamp tube 100 increases, and power consumption by the lamp tube 100 reduces.

However, at the fifth embodiment of the present invention in FIG. 8, voids can be formed between the lamp tube 100 and the first electrode 137 in comparison with the embodiments in FIGS. 3, 4 and 5. When voids is formed between the lamp tube 100 and the first electrode 137, the area acting as a electrode decreases and the power consumption increases.

This is because the volatile solvent volatilized from the adhesive member 200 cannot be exhausted rapidly from the space between the first electrode 137 and the lamp tube 100 toward an exterior of the first electrode 139.

The first electrode 137 of the embodiment in FIG. 8 has an electrode area larger than that of the first electrode 136 of the embodiment in FIG. 5. However, voids can be formed in the embodiment of FIG. 8 more easily than in the embodiment of FIG. 5. The first electrode 136 of the embodiment in FIG. 5 has an electrode area smaller than that of the first electrode 137 of the embodiment in FIG. 8. However, it is more difficult for the voids to be formed in the embodiment of FIG. 5 than in the embodiment of FIG. 8.

The embodiment of FIG. 9 can remove the drawbacks of the embodiments in FIGS. 5 and 8.

Figure 9A:
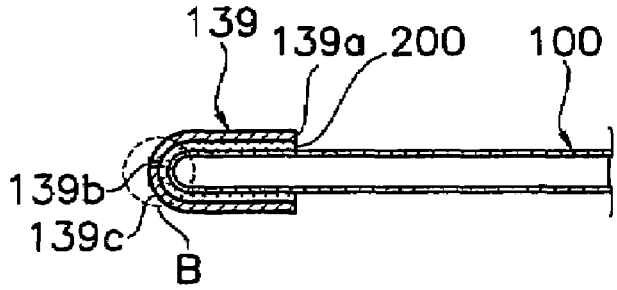
FIG. 9A is a cross-sectional view showing an assembling structure between a lamp tube and an electrode according to a sixth embodiment of the present invention.
Figure 9B:
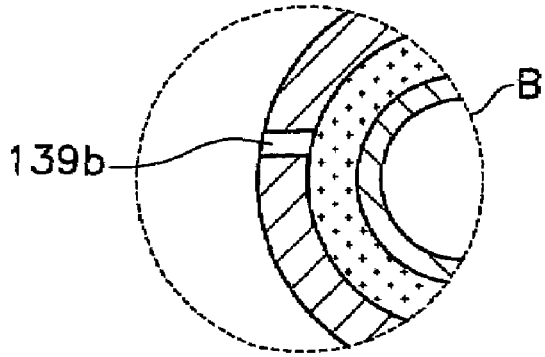
FIG. 9B is a partially enlarged view showing a second end portion of the first electrode shown in FIG. 9A.

FIG. 9A is a cross-sectional view showing an assembling structure between a lamp tube and an electrode according to a sixth embodiment of the present invention, and FIG. 9B is a partially enlarged view showing a second end portion of the first electrode shown in FIG. 9A. In FIG. 6, a first electrode according to the third embodiment of the present invention is indicated by a reference numeral "139".

Referring to FIG. 9A, the first electrode 139 has a bucket shape that covers the outer surface of the tube body 110, and is separated from the outer surface of the tube body 110 in a predetermined distance. The first electrode 139 has a first end portion 139*a* and a second end portion 139*c* opposite to the first end portion 139*a*. The first end portion 139*a* is opened to engage with the tube body 110 of the lamp tube 100 and the second end portion 139*c* is not opened. The adhesive member 200 having the silver component is interposed between the outer surface of the tube body 110 and the first electrode 139. Referring to FIG. 9B, an exhaust hole 139*b* is formed through the second end portion 139*c* of the first electrode 139. The volatility solvent volatilized from the adhesive member 200 is exhausted through the exhaust hole 139*b* toward an exterior of the first electrode 139. The exhaust hole 139*b* has a small size so as to maximize the size of the first electrode 139.

Figure 10A:
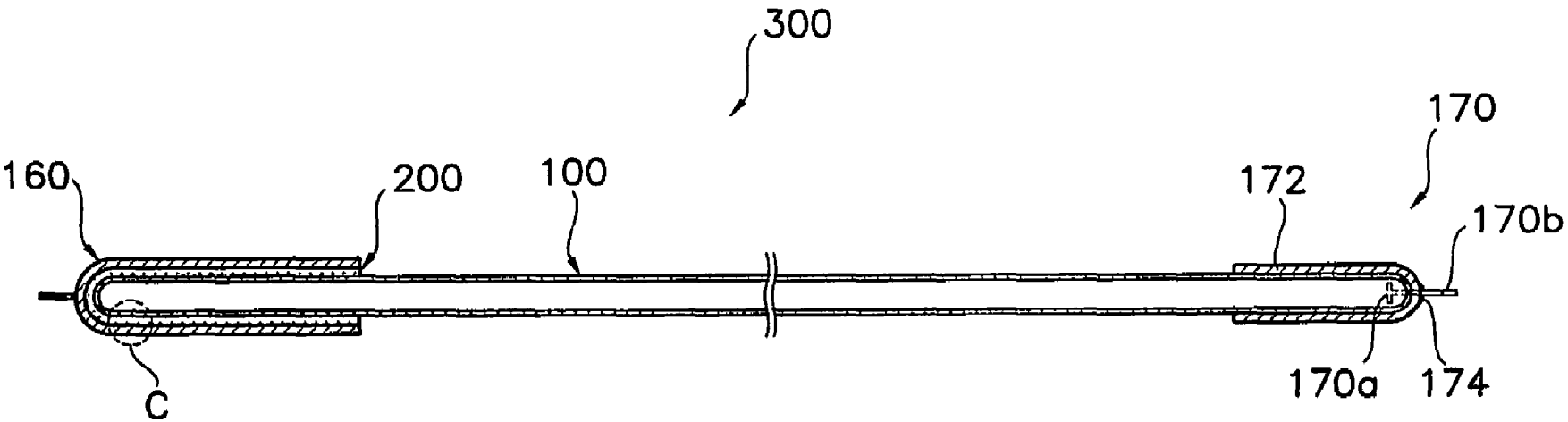
FIG. 10A is a cross-sectional view showing an assembling structure between a lamp tube and an electrode according to a seventh embodiment of the present invention.
Figure 10B:
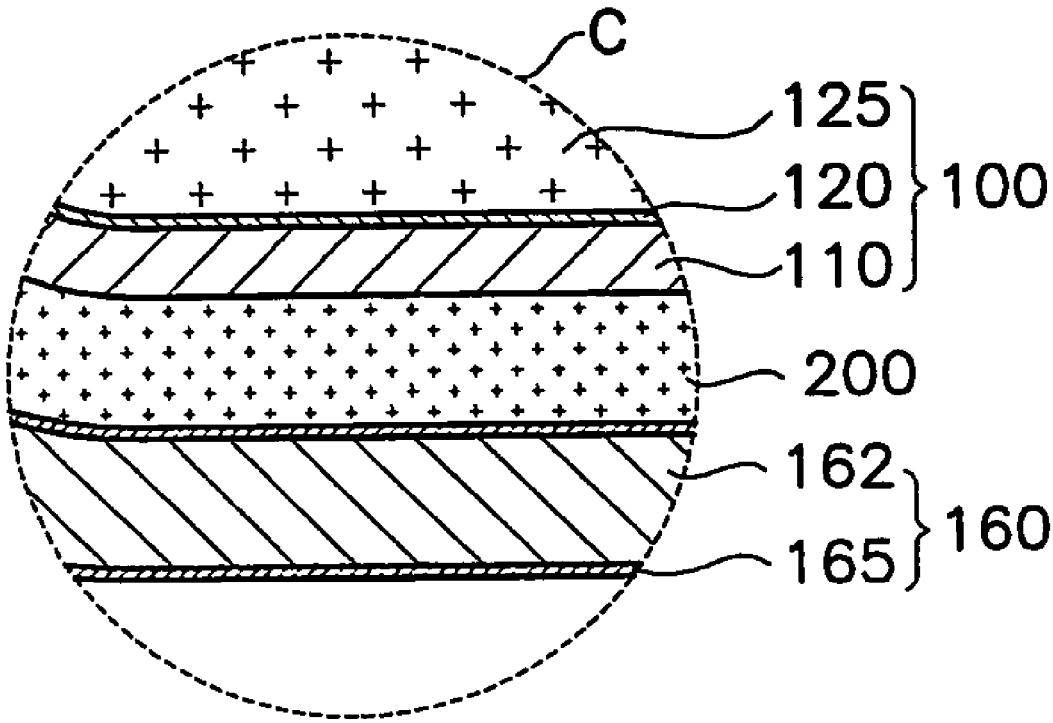
FIG. 10B is a partially enlarged view showing a lamp shown in FIG. 10A.

FIG. 10A is a cross-sectional view showing an assembling structure between a lamp tube and an electrode according to a seventh embodiment of the present invention, and FIG. 10B is a partially enlarged view showing a lamp shown in FIG. 10A.

Referring to FIG. 10A, a first electrode 160 is disposed on an outer surface of the tube body 110, and a second electrode 170 is disposed in the tube body 110. The second electrode 170 includes an inner electrode 170*a* positioned in the lamp tube 100 and a power line 170*b* that is connected with the inner electrode 170*a* and extended to the exterior of the tube body 110. A conductive socket 172 having a gilding surface is combined to one end portion of the lamp tube 100 in which the second electrode 170 is positioned. The conductive socket 172 has a through hole 172*a*. The power line 170*b* connected with the inner electrode 170*a* is withdrawn from the inside of the tube body 110 through the through hole 172*a* toward the exterior of the tube body 110. The power line 170*b* and the conductive socket 172 are soldered by solder 174. The adhesive member having a silver component can be interposed between the conductive socket 172 and the lamp tube 100.

Referring to FIG. 10B, the first electrode 160 includes a base metal 162 and a conductive antioxidant layer 165 formed on the base metal 162. Detailed descriptions about the base metal 162 and the conductive antioxidant layer 165 will not be given here, as detailed descriptions of the base metal 162 and the conductive antioxidant layer 165 was given already in FIG. 2.

Figure 11:
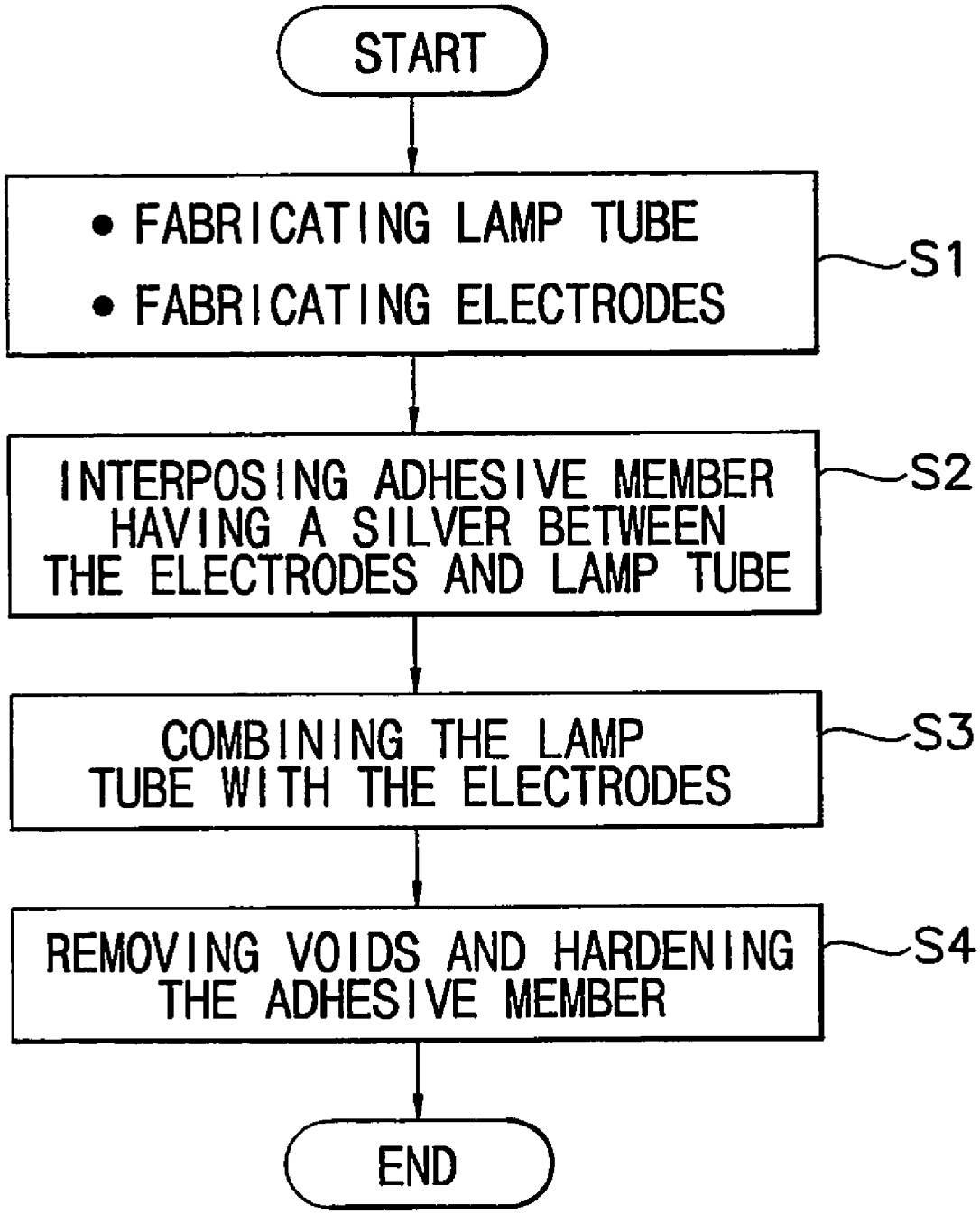
FIG. 11 is a flow chart illustrating a method of fabricating a lamp according to an exemplary embodiment of the present invention.

FIG. 11 is a flow chart illustrating a method of fabricating a lamp according to the present invention.

Referring to FIG. 11, the lamp tube and the first and second electrodes are fabricated (step S1). The lamp tube is fabricated by producing the tube body having the discharge space, by depositing the fluorescent material on the inner surface of the tube body, and then by sealing the tube body after injecting the discharge gas into the discharge space. The first and second electrodes are made of the nickel (Ni) or the copper (Cu) having the gilding surface.

The adhesive member having the silver component is formed on the outer surface of the tube body or the inner surface of the first and the second electrodes (step S2). Then, the first and the second electrodes are combined with the tube body on which the adhesive member is deposited (step S3). In step S3, the lamp tube is combined with the first and second electrode having the adhesive member. On the contrary, after forming the adhesive member on the tube body, the lamp tube is combined with the first and second electrode.

When heating the adhesive member interposed between the first and second electrodes and the lamp tube at a temperature of about 300 to about 400° C., preferably about 350° C., the adhesive member are hardened and expanded. Accordingly, the voids disposed between the first and the second electrodes and the lamp tube are removed (step S4).

Figure 12:
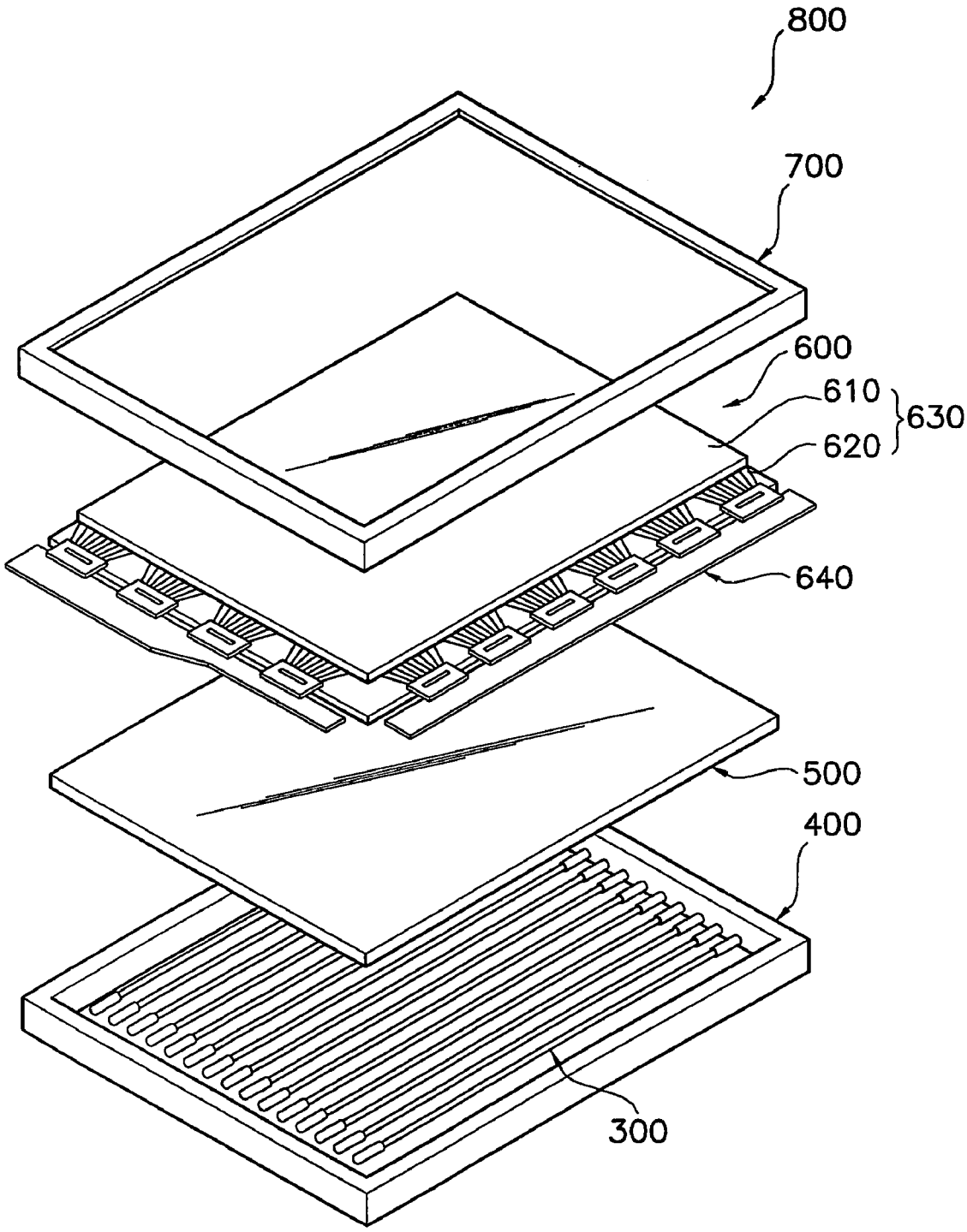
FIG. 12 is a perspective view showing an LCD apparatus having a lamp according to an exemplary embodiment of the present invention.
Figure 13:
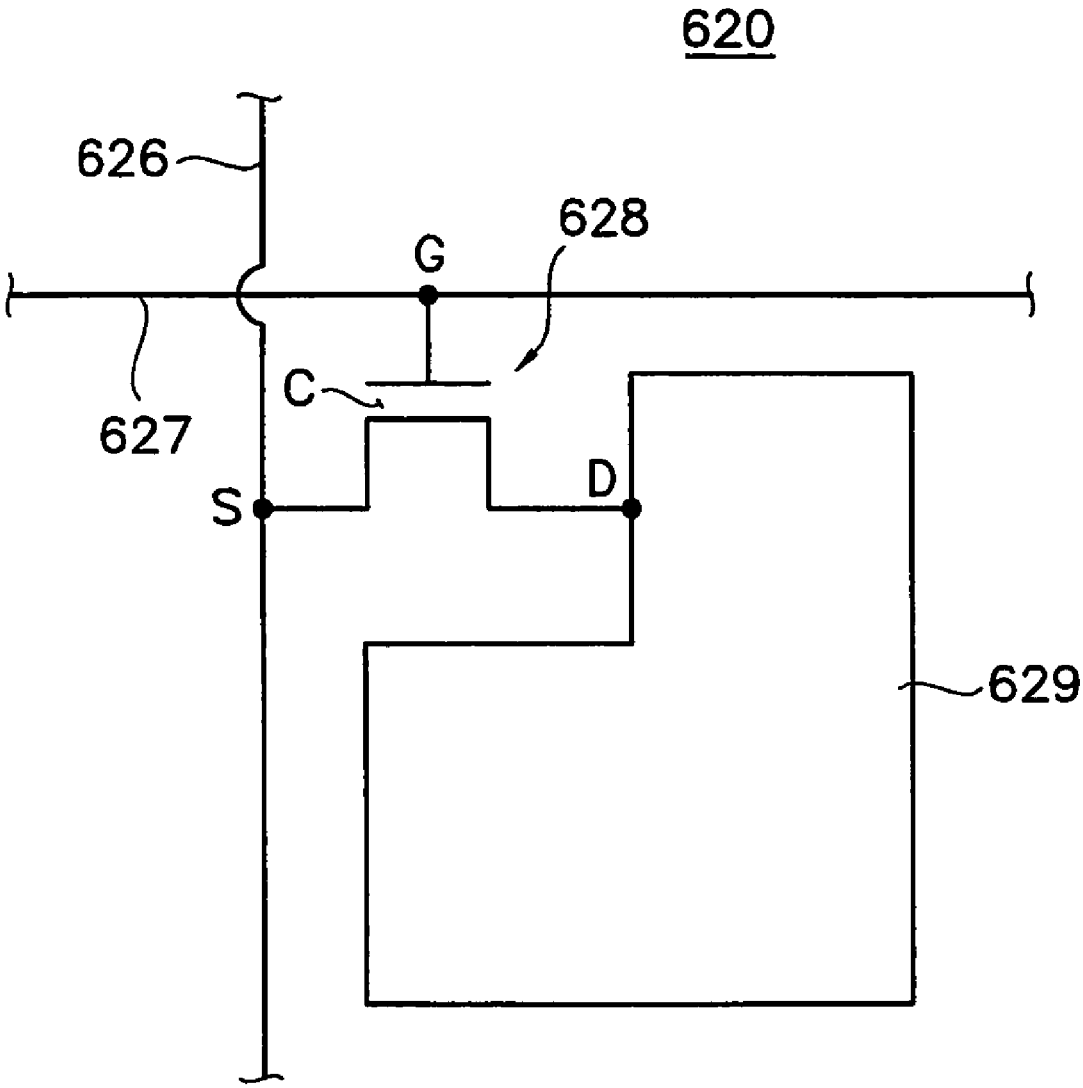
FIG. 13 is a circuit diagram showing a power supply unit disposed on a TFT substrate of a LCD panel shown in FIG. 12.

FIG. 12 is a perspective view showing an LCD apparatus having a lamp according to the present invention and FIG. 13 is a circuit diagram showing a power supply unit disposed on a TFT substrate of a LCD panel shown in FIG. 12.

Referring to FIG. 12, an LCD apparatus 800 includes an LCD panel assembly 600, a brightness enhancing member 500, a plurality of lamps 300, a receiving container 400 and a case 700. The lamps 300 are received in the receiving container 400.

The lamps 300 respectively includes the lamp tube 100 for generating a light, the first and second electrodes 130 and 150 being separated from each other and being disposed on the outer surface of the lamp tube 100, for supplying the power voltage to the lamp tube 100, and the adhesive member having a silver component and being interposed between the electrodes (the first and second electrodes) and the lamp tube 100.

As shown in FIG. 12, a plurality of lamps 300 is disposed on a bottom of the receiving container 400 in parallel, and is connected with a power supply unit (not shown). Each of the plurality of lamps 300 has similar brightness properties by disposing the first and second electrodes 130 and 150 on the outer surface of the lamp tube 100.

The brightness enhancing member 500 is disposed between the lamps 300 and the LCD panel assembly 600 so as to reduce a brightness difference among the lamps 300. The LCD apparatus 800 employs a diffusion plate as the brightness enhancing member 500. When the lights generated from the pluralities of lamps 300 pass through the brightness enhancing member 500, the lights have a uniform brightness distribution as a surface light source, and the lights is provided to a user as an image through the LCD panel assembly 600.

The LCD panel assembly 600 includes an LCD panel 630 having a TFT substrate 620, a color filter substrate 610, a liquid crystal (not shown) interposed between the TFT substrate 620 and the color filter substrate 610, and a driving module 640 for applying a driving signal to the LCD panel 630.

As shown in FIG. 13, the TFT substrate 620 of the LCD panel 630 includes a transparent pixel electrode 629 and a power supply unit 628 for applying the power voltage to the transparent pixel electrode 629.

The TFT substrate 620 employs a TFT as the power supply unit 628. The TFT 628 includes a gate electrode G, a drain electrode D, a source electrode S and a channel layer C. The gate electrode G and the source electrode S are connected with a gate line 627 and a data line 626, respectively. The color filter substrate 610 facing to the TFT substrate 620 includes a color filter formed on a transparent substrate and a common electrode formed on the transparent substrate to cover the color filter. The color filter faces to the pixel electrode.

According to the LCD apparatus of the present invention, the electrodes for generating the light are disposed on the outer surface of the lamp tube, thereby reducing power consumption. Also, the LCD apparatus of the present invention can solve the non-uniform brightness problem when the plurality of lamps is connected with the power supply unit in parallel, and simultaneously can solve some problems when the electrodes is formed on the outer surface of the lamp tube.

This invention has been described above with reference to the exemplary embodiments. It is evident, however, that many modifications and variations will be apparent to those having ordinary skill in the art in light of the foregoing description. Accordingly, the present invention embraces all such alternative modifications and variations as fall within the spirit and scope of the appended claims.

The invention claimed is:

1. A lamp comprising:

a lamp tube for receiving a power voltage to generate a light;

a pair of electrodes for supplying the power voltage to the lamp tube, the pair of electrodes being separated from each other, and at least one electrode of the pair of electrodes being disposed on a first outer surface of the lamp tube as an outer electrode and including a conductive antioxidant layer; and an adhesive means having a silver component and being disposed between the outer electrode and the lamp tube.

2. The lamp of claim 1, wherein the conductive antioxidant layer is made of a metal having a gilding surface.

3. The lamp of claim 1, wherein the outer electrode has a pipe shape having a first end portion, a second end portion opposite to the first end portion and a body portion that connects the first end portion with the second end portion, the first and second end portions being opened and the body portion being separated from the first outer surface of the lamp by a predetermined distance.

4. The lamp of claim 1, wherein the outer electrode has a bucket shape having a first end portion, a second end portion opposite to the first end portion and a body portion that connects the first end portion with the second end portion, the first end portion being opened and the body portion being separated from the first outer surface of the lamp by a predetermined distance.

5. The lamp of claim 4, wherein the adhesive means is disposed on an inner surface of the outer electrode.

6. The lamp of claim 4, wherein the adhesive means is disposed on the first outer surface of the lamp tube.

7. The lamp of claim 4, wherein an exhaust hole for exhausting a gas generated by the adhesive means is formed at the second end port ion of the outer electrode.

8. The lamp of claim 1, wherein at least one electrode of the pair of electrodes is positioned in the lamp tube as an inner electrode and the inner electrode flirt her comprises a power line of which a first end portion is connected with the inner electrode and a second end portion is extended to a second outer surface of the lamp tube.

9. The lamp of claim 8, wherein the lamp tube comprises a conductive socket combined to the second outer surface of the lamp tube, the conductive socket having a through hole through which the power line is extended to the second outer surface of the lamp tube, and the power line being soldered with the conductive socket.

10. The lamp of claim 9, wherein the conductive socket is gold-plated.

11. The lamp of claim 1, wherein the adhesive means further comprises a silver grain, an adhesive resin, and a volatile solvent.

12. The lamp of claim 11, wherein the adhesive means further comprises an antioxidant additive for preventing the silver grain from being oxidized.

13. A method of fabricating a lamp, comprising the steps of:

fabricating a lamp tube for receiving a power voltage to generate a light and an electrode being disposed on a first outer surface of the lamp tube as an outer electrode, the electrode including a conductive antioxidant layer;

forming an adhesive means including a silver between the lamp tube and the outer electrode; and hardening the adhesive means such that the lamp tube is adhered to the electrode.

14. The method of claim 13, wherein the adhesive means is hardened by being heated at a temperature of about 300 to about 400° C.

15. The method of claim 13, wherein the adhesive means further comprises a silver grain, an adhesive resin, a volatile solvent and an antioxidant for preventing the silver grain from being oxidized.

16. The method of claim 13, wherein the adhesive means is formed on the lamp tube.

17. The method of claim 13, wherein the adhesive means is formed on the outer electrode.

18. An LCD apparatus comprising:

a lamp including a lamp tube for receiving a power voltage to generate a first light, a pair of electrodes for supplying the power voltage to the lamp tube, the pair of electrodes being separated from each other and at least one electrode of the pair of electrodes being disposed on a first outer surface of the lamp tube as an outer electrode and including a conductive antioxidant layer, and an adhesive means having a silver and being disposed between the outer electrode and the lamp tube;

a brightness enhancing means for increasing a brightness of the first light, and;

an LCD panel for receiving a second light supplied from the brightness enhancing means and displaying an image in response to the second light.

19. The LCD apparatus of claim 18, wherein the conductive antioxidant layer is made of a metal material having a gilding surface.

* * * * *